US005588235A

United States Patent [19]

Juchymenko et al.

[11] Patent Number: 5,588,235

[45] Date of Patent: Dec. 31, 1996

[54] LIGHT PROCESSING APPARATUS FOR CREATING VISUAL EFFECTS

[75] Inventors: Victor Y. Juchymenko, Toronto; J. Richard Howard, Oakville; Andrew J. Laczynski; James S. Angus, both of Toronto, all of Canada

[73] Assignee: Roberts Systems, Inc., Charlotte, N.C.

[21] Appl. No.: 252,007

[22] Filed: May 31, 1994

Related U.S. Application Data

[63] Continuation-in-part of Ser. No. 79,585, Jun. 22, 1993, Pat. No. 5,508,892.

[51] Int. Cl.[6] ..... G09F 13/04

[52] U.S. Cl. ..... 40/547; 40/442

[58] Field of Search ..... 40/547, 442, 444; 362/32

[56] References Cited

U.S. PATENT DOCUMENTS

| | | | |
|---|---|---|---|
| 1,351,562 | 8/1920 | Foster . | |
| 3,184,872 | 5/1965 | Way . | |
| 3,564,233 | 2/1971 | Cox et al. . | |
| 3,803,398 | 4/1974 | Walker . | |
| 3,815,986 | 6/1974 | Darbee . | |
| 3,836,911 | 9/1974 | Gibson et al. | 40/547 |
| 3,912,361 | 10/1975 | Bentley . | |
| 3,948,209 | 4/1976 | Takemoto et al. | 40/547 X |
| 3,962,702 | 6/1976 | Kriege . | |
| 4,048,486 | 9/1977 | Kriege . | |
| 4,106,231 | 8/1978 | MacNiel | 40/547 |
| 4,141,058 | 2/1979 | Mizohata et al. . | |
| 4,212,516 | 7/1980 | Sawamura . | |
| 4,279,089 | 7/1981 | Murakami | 40/547 |
| 4,385,344 | 5/1983 | Gonser . | |
| 4,745,525 | 5/1988 | Sheehy | 362/32 |
| 4,747,022 | 5/1988 | Lin | 362/32 |
| 4,747,648 | 5/1988 | Gilliand, III . | |
| 4,800,474 | 1/1989 | Bornhorst . | |
| 4,807,092 | 2/1989 | Hasegawa | 362/32 |
| 4,860,475 | 8/1989 | Levy et al. | 40/547 |
| 4,917,448 | 4/1990 | Oppenheimer . | |
| 4,996,632 | 2/1991 | Aikens . | |
| 5,053,765 | 10/1991 | Sonehara et al. . | |
| 5,111,183 | 5/1992 | Wang | 40/547 X |
| 5,150,445 | 9/1992 | Toyoda et al. . | |
| 5,184,253 | 2/1993 | Hwang . | |
| 5,247,600 | 9/1993 | Williams et al. | 40/547 |
| 5,260,686 | 11/1993 | Kuo | 362/32 X |

FOREIGN PATENT DOCUMENTS

| | | |
|---|---|---|
| 854701 | 1/1940 | France . |
| 0262277 | 4/1988 | France . |
| 2437580 | 11/1975 | Germany . |
| 2806076 | 8/1979 | Germany . |
| 9205054.9 | 3/1993 | Germany . |
| 2073930 | 10/1981 | United Kingdom . |

*Primary Examiner*—Joanne Silbermann
*Attorney, Agent, or Firm*—Hardaway Law Firm PA

[57] ABSTRACT

Light processing apparatus creates a number of visual effects which simulate movement with light from a light source. A multiplicity of flexible fibre optic light guides having optically finished input and output ends are grouped into groups, with each group being assigned to create a particular effect. The input ends of each group of light guides are placed in adjacent receptor zones of pre-selected geometry, and the output ends of each group of light guides are located on an effects surface in a pre-selected pattern. Light from the light source is filtered by a color changer having a plurality of discrete moveable colored filter zones shaped to correlate with the receptor zones, and is then received by the input ends of the light guides and distributed to the output ends of the light guides. The color changer may be a rotatable color wheel filter, an endless band filter or a cylindrical filter. When the filter is activated, the filter zones successively register with and sweep across the receptor zones, thereby changing the color of the light which is transmitted to the input ends of the various groups of light guides. The subject apparatus also includes a configuration structure which holds the input and output ends of the light guides in pre-selected positions, supports and positions the light source and filter, and encapsulates the light guides. The light processing apparatus can be incorporated into a sign or other lighting product having a display panel or other device for displaying the visual effects.

17 Claims, 7 Drawing Sheets

LIGHT PROCESSING APPARATUS FOR CREATING VISUAL EFFECTS

This application is a continuation-in-part of application Ser. No. 079,585 filed on Jun. 22, 1993 now U.S. Pat. No. 5,508,892.

FIELD OF THE INVENTION

The present invention relates to light processing apparatus for creating visual effects with light from a light source, and to signs, display panels and other lighting products utilizing such processing apparatus.

BACKGROUND OF THE INVENTION

Various conventional decorative or display lighting devices utilize fibre optics or light guides. Typically, white light from a light source is passed through a colour wheel onto the circular common end of a harness of fibre optic light guides. The output ends or "tails" of the fibre optic light guides are then positioned on a display surface such as a sign in a pre-selected pattern to create a desired visual effect. The colour wheel may be rotated through a sequence of colours so as to create an end effect which simulates movement and flow.

Existing decorative lighting devices suffer from a number of drawbacks, including uneven illumination. When the colour wheel is rotated, a color front initially illuminates only a few of the light fibres situated at the edge of the common end. As the colour front moves across the surface of the common end, an increasing number of light fibres are illuminated, but as the colour wheel continues its movement, fewer light fibres are illuminated. The net result is disproportionate illumination and uneven colour flow. Another problem with conventional lighting systems is the risk of heat damage to colour wheels caused by high intensity focused light, including discoloration, distortion and disintegration. This problem can be avoided by using colour wheels made from relatively robust and expensive materials such as glass, but glass colour wheels are heavy and require larger drive motors. Standard colour wheels are also incapable of utilizing the full spectrum of colour combinations. Furthermore, conventional systems are inefficient in that they do not facilitate the sequencing of fibre optic strands into pre-determined positions to create a desired end effect.

There is accordingly a need for a low cost light processing system which overcomes the problems associated with the prior art.

SUMMARY OF THE INVENTION

The present invention is directed to light processing apparatus for creating visual effects with light from a light source. The subject light processing apparatus comprises input light distribution means for distributing light from the light source into a plurality of input light paths, having input ends for receiving light from the light source and output ends, input light path reconfiguring means for reconfiguring the output ends of the input distribution means into a plurality of separated input zones of selected shape, filtering means for filtering the light emitted from the output ends of the input distribution means having filtering areas shaped to correlate with the input zones for transmitting light of pre-selected colours, filtered light distribution means for distributing the light transmitted through the filtering means into a plurality of output light paths, having input ends and output ends, and filtered light configuring means for configuring the input ends of the filtered light distribution means into output zones shaped to correlate with the input zones.

In a preferred embodiment, the subject processing apparatus comprises light distribution means for distributing light from the light source into a multiplicity of light paths, comprising an input bundle of flexible fibre optic light guides having optically finished input ends for receiving light from the light source and optically finished output ends, input light path reconfiguring means for reconfiguring the output ends of the light guides into a plurality of separated input zones of selected shape, filtering means for filtering the light being emitted from the output ends of the input bundle of light guides having filtering areas to correlate with the input zones adapted to transmit light of pre-selected colours, filtered light distribution means for distributing the light transmitted through the filter means, comprising an output bundle of flexible fibre optic light guides having optically finished input and output ends, and filtered light path configuring means for configuring the input ends of the second bundle of light guides into output zones shaped to correlate with the input zones.

The input zones may comprise a series of concentric arcuate paths. The filtering means may comprise a rotatable circular colour wheel having coloured annular sectors, each of which is adapted to overlap respective arcuate paths on the input light point configuring means. The output zones of the filtered light path configuring means are preferably shaped to be mirror images of the concentric arcuate input zones.

Alternatively, the filtering means may be a computer-controlled active filter comprising a liquid crystal matrix having a series of filtering zones which change colour when the filter is activated. In this embodiment, the input and output zones comprise a series of paths which correlate with the filtering zones.

In its presently preferred embodiment, the subject invention is a light processing apparatus for creating a pre-selected number of special effects on a display surface which simulate movement, using light from a light source. The apparatus comprises a multiplicity of flexible fibre optic light guides having optically finished input ends for receiving the light from the light source and optically finished output ends, the light guides being grouped into groups, each group being assigned to create a particular special effect. The input ends of each group of light guides are placed in receptor zones of pre-selected geometry and the output ends of each group of light guides are positioned in a pre-selected pattern. The apparatus also comprises colour changing means having a plurality of discrete moveable coloured filter zones for transmitting light of various colours, wherein each of the filter zones is shaped to correlate with one of the receptor zones. As the filtering means moves, the respective filter zones register with and sweep across correlated receptor zones. This action periodically changes the colour of the light transmitted to the input ends creating special effects on the effects surface which simulate movement.

The receptor zones may comprise a series of concentric arcuate sectors, and the colour changing means may comprise a rotatable circular colour wheel filter having filter zones in the shape of sectors of an annulus, each of which is adapted to overlap an arcuate receptor zone.

Alternatively, the colour changing means may comprise an endless flexible colour band filter having filter zones in the form of adjacent parallel linear sectors, each of which is adapted to overlap a parallel linear receptor zone.

In the further alternative, the colour changing means may comprise a rotatable colour cylinder having filter zones in the form of stacked, parallel sections of a cylinder, each of which is adapted to overlap a similarly-shaped receptor zone.

In the presently preferred embodiment, the subject invention comprises configuring means for configuring the input ends and the output ends of the light guides in pre-selected positions. The configuring means preferably comprises a foam body having separate surfaces for supporting and positioning the input ends of the light guides, and the output ends of the light guides. The configuring means also preferably encapsulates the light guides along the length thereof.

The subject light processing system may be incorporated into the housing of a display sign which includes display means for displaying light emitted from the output ends of the output bundle of light guides in pre-selected patterns. Pre-determined visual effects are displayed on the display means when the filter is activated.

The light processing apparatus of the present invention may also be utilized in a number of applications, including decorative signs, spot lights, directional panels such as those which display arrows and like moving symbols, information panels such as an interactive map showing bus stop locations, and other lighting products.

BRIEF DESCRIPTION OF THE DRAWINGS

The invention will now be described with reference to the accompanying drawings, in which.

BRIEF DESCRIPTION OF THE EMBODIMENTS

Figure 1:
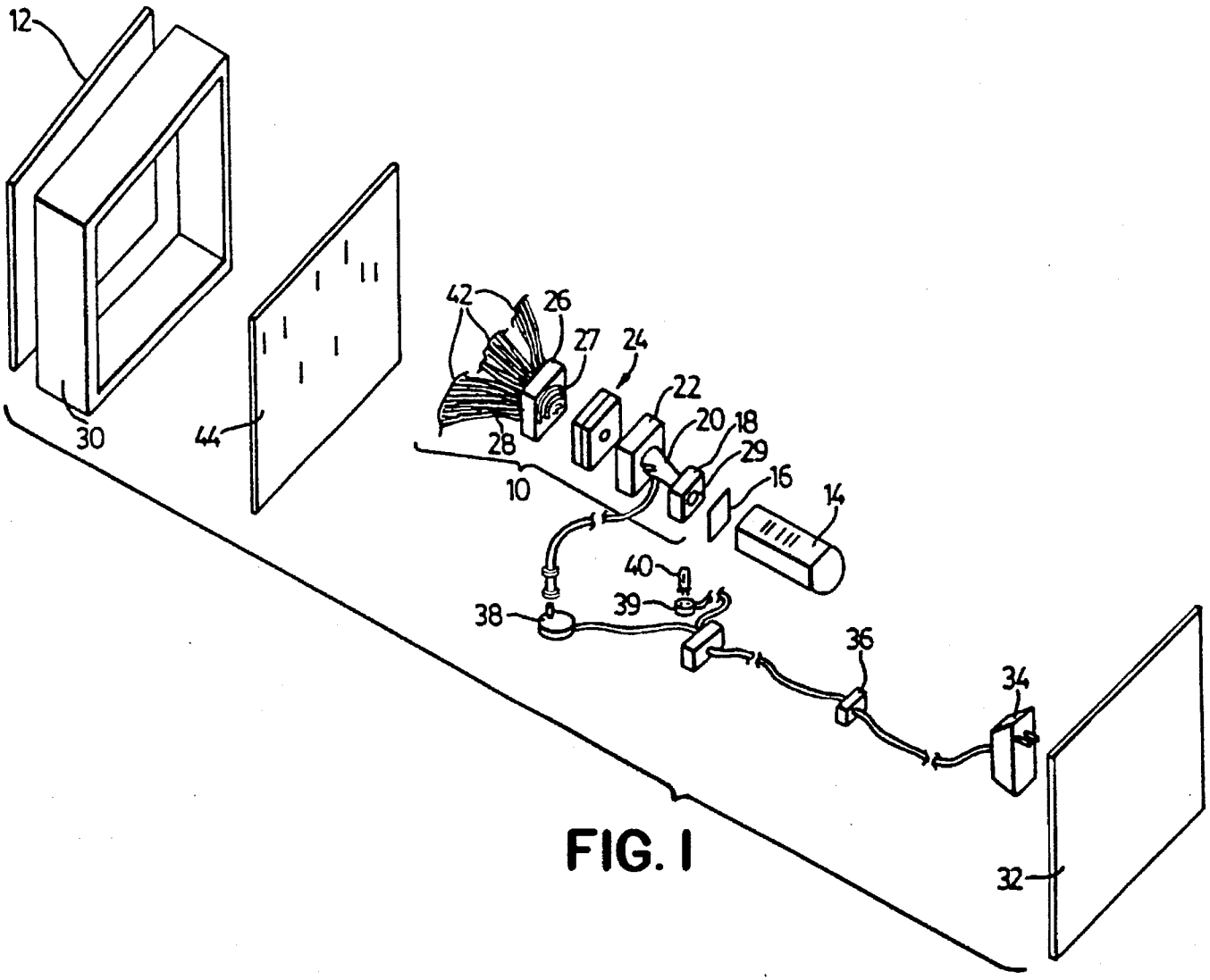
FIG. 1 is an exploded diagrammatic view of the light processing apparatus of the subject invention.

FIG. 1 illustrates in a diagrammatic fashion the main elements of the light processing or management apparatus of the subject invention, shown generally as 10. Light processing apparatus 10 is used to generate visual effects on a sign front or display panel 12, with light from a light source 14, preferably focused into a circular pattern by lens 16. Processing apparatus 10 comprises common end plate 18, input bundle or harness of fibre optic light guides 20, input light path reconfiguration plate 22, colour filter assembly 24, output light path configuration plate 26, and output bundle or harness of fibre optic light guides 28.

Common end plate 18 preferably has a large, central circular aperture for holding the input ends of input bundle of light guides 20, so as to form common end 29 which receives light from light source 14. Alternatively, a common end plate aperture could be square or rectangular, depending on the geometry of the light beam created by light source 14. Output light path configuration plate 26 has a series of slots 27 for holding the input ends of output bundle of light guides 28. Input light path reconfiguration plate 22 has a similar series of slots, which are preferably mirror-images of slots 27, for holding the output ends of input bundle of light guides 20. As shown in FIG. 1, slots 27 are arcuate or curved, so as to be used in conjunction with an active filter assembly comprising a rotatable colour wheel having circular geometry. Alternatively, the filter assembly could be a computer-controlled active filter comprising a liquid crystal screen having coloured areas, as discussed in more detail herein below, in which case slots 27 may not be curved.

Processing apparatus 10 may be incorporated into a sign or other display means by mounting it within housing 30 between display panel 12 and sign back 32. The sign preferably includes transformer 34, terminal block 36, AC or DC motor 38 for activating colour filter assembly 24, and a lamp socket 39 for holding light 40. Output or effect ends 42 of guides 28 are mounted onto intermediate support panel 44.

Input and output bundles of fibre optic light guides 20, 28 are preferably low-cost plastic (polymethyl methacrylate) fibres, although they may be glass (silica) fibres. The input and output ends of both bundles of light guides 20, 28 are highly polished or otherwise optically finished to an optical quality standard so that maximum light transmission is achieved.

Light emitted from light source 14 is focused by lens 16 onto circular common end 29. Input bundle of light guides 20 distributes this light into a multiplicity of light paths separated into a plurality of input zones created by the output ends of the light guides held in the series of slots in input configuration plate 22. The light transmitted through these input zones is then filtered by colour filter assembly 24, and is received by corresponding output zones created by the input ends of the output bundle of light guides 28 held in slots 27 in output configuration plate 26. The light is then distributed by the output ends or "tails"42 of light guide bundle 28 to pre-selected locations on support panel 44, so as to illuminate selected translucent areas of display panel 12. Special effects simulating movement and flow are created when colour filter 24 is activated.

Figure 2:
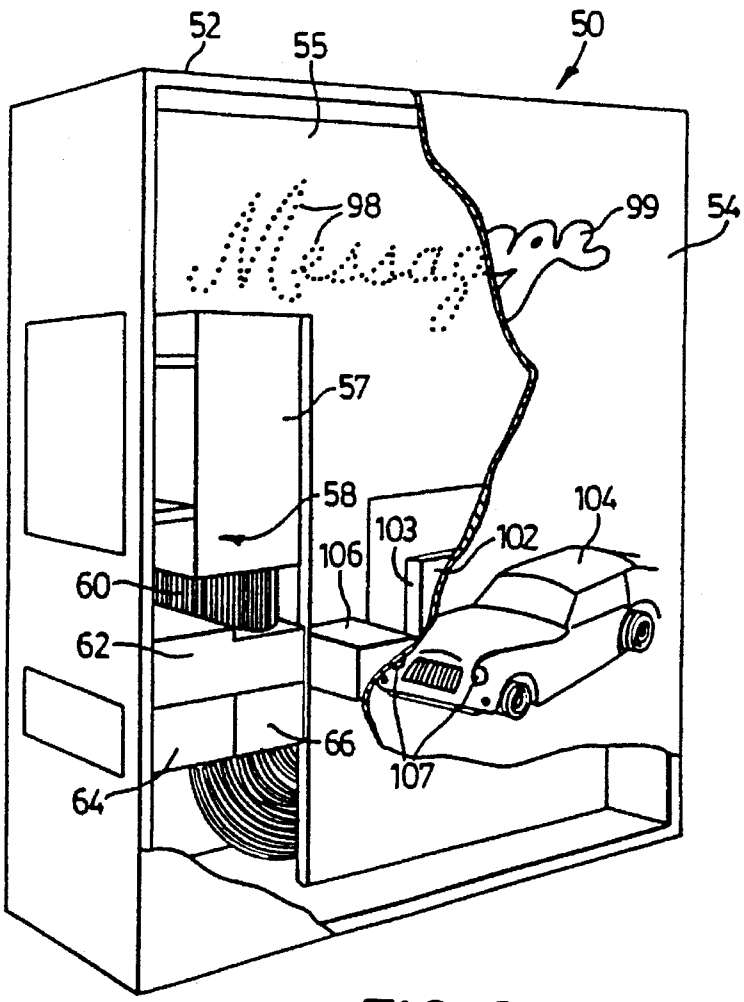
FIG. 2 is a perspective view of a sign embodying a preferred embodiment of the subject light processing apparatus, with the front panel partially broken away.
Figure 3:
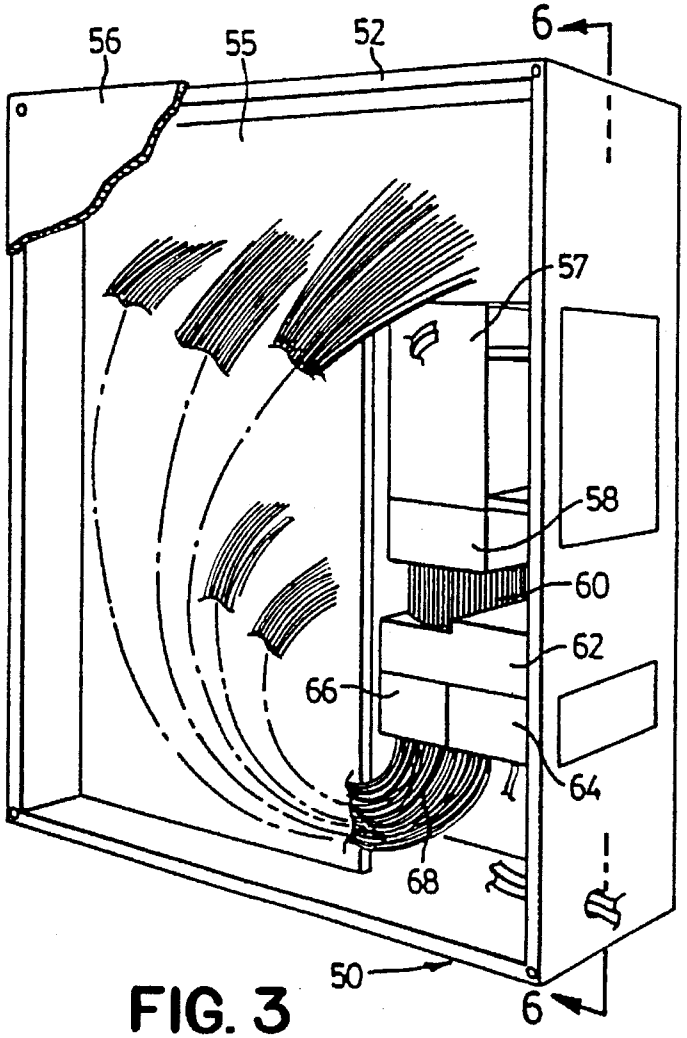
FIG. 3 is a perspective view of the back of the sign shown in FIG. 2, with the back panel mostly broken away.

FIGS. 2–9 illustrate a visual effects sign 50 embodying a preferred embodiment of the light processing apparatus of the subject invention. As shown in FIG. 2 and FIG. 3, sign 50 comprises housing 52, front effect panel 54, intermediate support panel 55, back panel 56, light source 57, common end plate 58, input bundle of light guides 60, input light path reconfiguration plate 62, colour wheel assembly 64, output light path configuration light 66, and output bundle of light guides 68.

Figure 4:
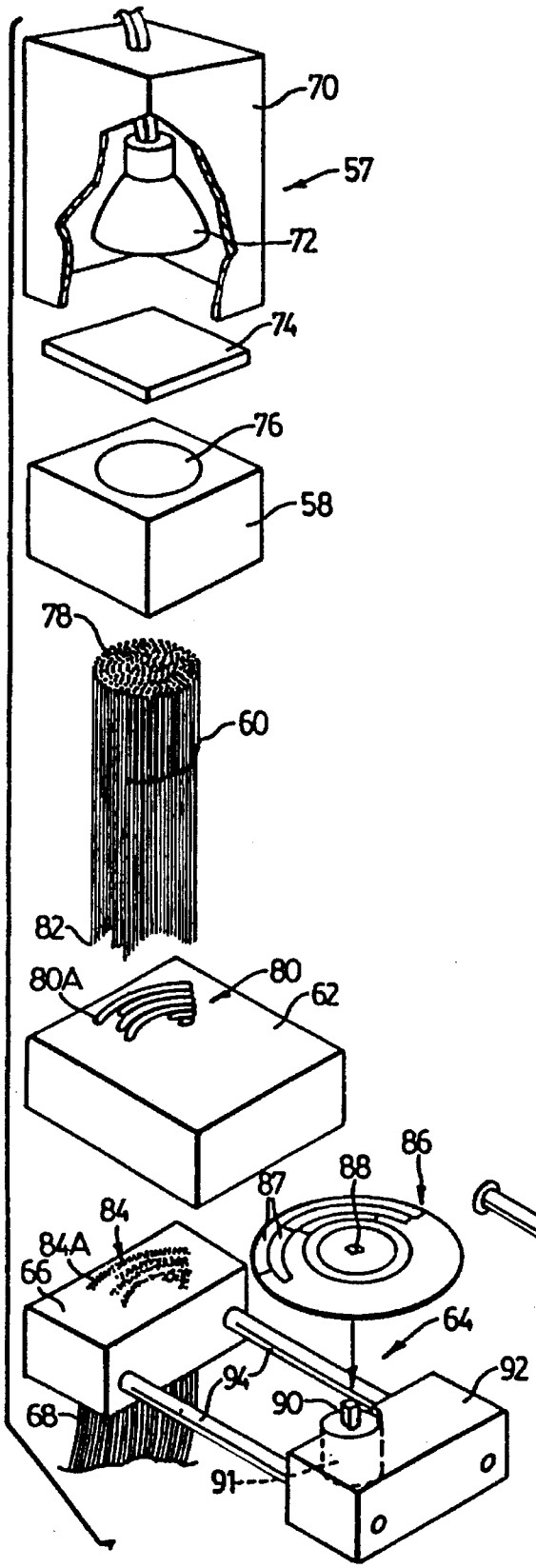
FIG. 4 is an exploded perspective view of the components of the preferred embodiment of the subject light processing apparatus.

FIG. 4 is an exploded perspective view of the subject light processing apparatus comprising common end plate 58, input bundle of light guides 60, input light path reconfiguration plate 62, colour wheel assembly shown generally as 64, output light path configuration plate 66, and output bundle of light guides 68. Light source 57 includes light housing 70 having mounted therein light bulb 72 and lens 74.

Common end plate 58 has circular aperture 76 for holding input ends 78 of input bundle of light guides 60. Input light path reconfiguration plate 62 has a series of arcuate slots 80 for receiving the output ends 82 of input bundle of light guides 60. Output light path configuration plate 66 has a series of arcuate slots 84, which are mirror-images of slots 80, for receiving the input ends of output bundle of light guides 68. The ends of the light guides are cut flush with the surfaces of plates 62, 66 and highly polished to an optical standard.

plates 62, 66 are preferably blocks of brass, polyethylene or similar material, depending upon the nature of the fibre optics used for light guides 60, 68. Slots 80, 84 are preferably in the shape of a section of an annulus or ring. The width and length of slots 80, 84 are selected depending upon the desired end effect to be created. Most end effects will require their own slot, although it is possible to create more than one separate visual effect with the same slot by appropriate positioning of the tails of the light fibres held in such slot.

Figure 5:
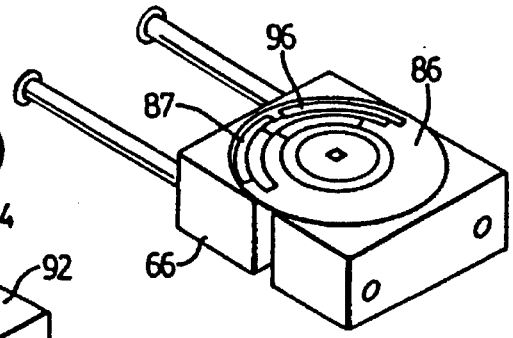
FIG. 5 is a perspective view of the colour wheel assembly of the subject processing apparatus shown in its operating position.

Colour wheel assembly 64 comprises colour wheel 86 having a square central aperture 88 sized to fit square boss 90 on the drive shaft of motor 91 mounted on block 92. A pair of spaced rails 94 extend laterally from block 92 and are slidably received in apertures in output light path configuration plate 66. In FIG. 4, block 92 is shown in its extended position, allowing for colour wheel 86 to be conveniently removed from drive shaft 90. In FIG. 5, block 92 is shown in its operating position in which colour wheel 86 is shown in place covering arcuate slots 84 of plate 66. Alternatively, the colour wheel assembly could be fixed in place or mounted on a hinged block which would allow the colour wheel to be removed conveniently by swinging the front portion of the block outwardly.

Figure 6:
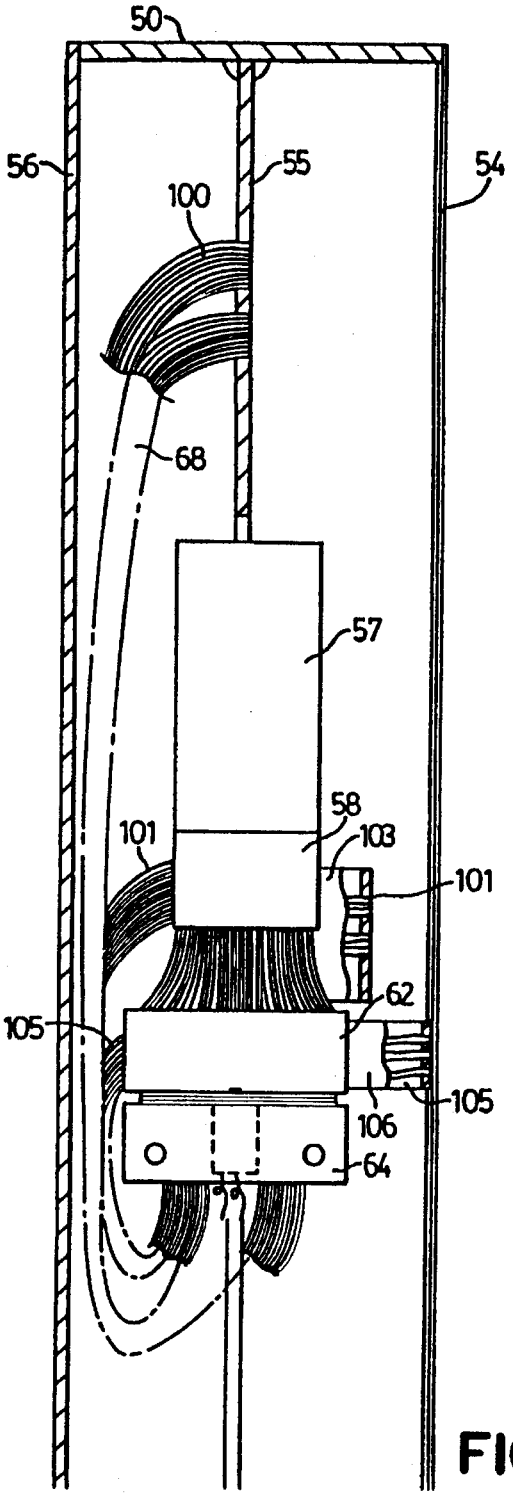
FIG. 6 is a sectional view taken along lines 6—6 in FIG. 3.

Referring to FIG. 6 and FIG. 2, mounted within housing 50 is an intermediate support panel 55, for supporting the various components of the subject decorative lighting control apparatus. Support panel 55 also holds the output ends or "tails" of the light fibres contained in output bundle of light guides 68. The tails of some light fibres 100 may be mounted directly in apertures 98 in support panel 55 to form the letters of the "Message" shown in FIG. 2. Other light fibres 101 may be mounted in apertures 102 in block 103 mounted onto the front surface of support panel 55 to bring the tails of fibres 101 closer to the translucent design such as the representation of an automobile 104 on the front surface 54 of sign 50. Still other light fibres 105 are mounted on thicker block 106 secured to support panel 55 to create a brighter visual effect such as the headlight 107 of automobile 104.

Figure 7:
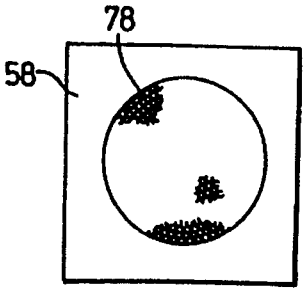
FIGS. 7, 8 and 9 are plan views of components of the preferred embodiment of the subject apparatus.
Figure 8:
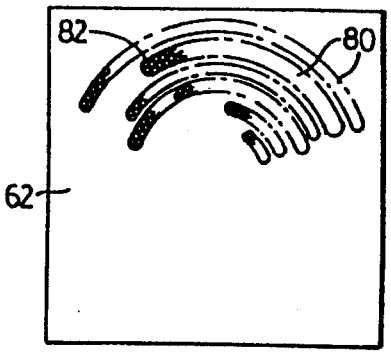
Figure 9:
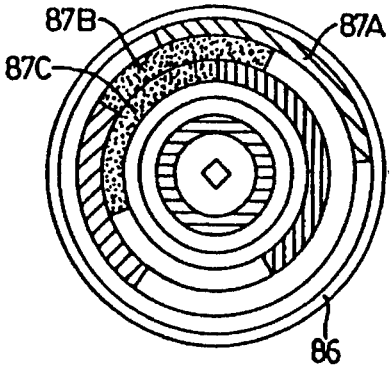

Referring now to FIGS. 7 and 8, shown therein are plan views of common end plate 58 and input light point reconfiguration plate 62, respectively. Input ends 78 of input bundle of light guides 60 are securely held in the central aperture of common end plate 58. The output ends 82 of input bundle of light guides 60 are reconfigured and mounted in curved or arcuate slots 80 of input light point configuration plate 62, as shown in FIG. 7. preferably, each arcuate slot 80 is wide enough to hold the output ends of two light fibres. The length of arcuate slots 80 depends upon the particular optical effect to be created. Alternatively, some or all of the apertures in plates 62, 66 could take the form of radially extending slots or circular apertures depending upon the desired end effect.

As shown in FIG. 8, colour wheel 86 is preferably a circular disc of acetate film, created either by printing from a computer program using a QMS system or the like, or by a film process such as Cibachrome or similar film transfer process. Colour wheel 86 includes a plurality of coloured zones 87A, 87B, 87C, etc. in the shape of annular sectors of a circle, which correspond in width to arcuate slots 80, 84 to prevent light cross-over from one zone to another. Coloured zones may be of one or more colours or transparent in whole or in part. The length of colour zones 87 depends upon the duration of the desired visual effect. In the case of each annular sector 87, the portion of the annulus which is not coloured is opaque to prevent light from being transmitted through such portion.

In operation, light emitted from light 72 of light source 57 is focused by lens 74 onto common end 76 of common end plate 58. First bundle of light guides 60 then distributes this light into a multiplicity of light paths separated into a plurality of light zones created by the output ends 82 of input bundle of light guides 60 held in arcuate slots 80. Light from output ends 82 of input bundle 60 is then transmitted through colour wheel 86 and is received by input ends 84 of output bundle of light guides 68. As the input zones 80 are mirror images of output zones 84, all of the light in a particular input zone 80A is received by corresponding output zone 84A. This light is then distributed by output bundle of light guides 68 to pre-selected locations behind display panel 54. As colour wheel 86 is rotated by motor 91, various colour zones 87 periodically register with arcuate slots 80, 84, resulting in the periodic transmission of filtered light.

As the leading edge of each coloured zone 87 crosses the front end of fibre optically filled slots 80, 84, the coloured light is transmitted through such fibres to display panel 54, creating the effect of movement and flow. Different designs require different colour wheels and plates 60, 68 having an appropriate number of slots of appropriate length. A "painting with light" effect can be created by proper sequencing of the output ends of the output bundle of light guides 68 on the display panel, i.e. by placing the light fibres located in the front of the arcuate slot at the beginning of the design, such as the first letter of a word, and so on.

Different end effects can be created by varying the length of arcuate slots 80, 84 and the length of colour wheel zones 87. For example, a short burst of colour running through an effect would be produced by a short colour wheel zone and a correspondingly long slot on configuration plates 60, 68. Conversely, an area on the display panel which continuously changes colour would require a colour path or zone around the full circumference of the colour wheel 86 and a short slot on plates 60, 68.

Figure 10:
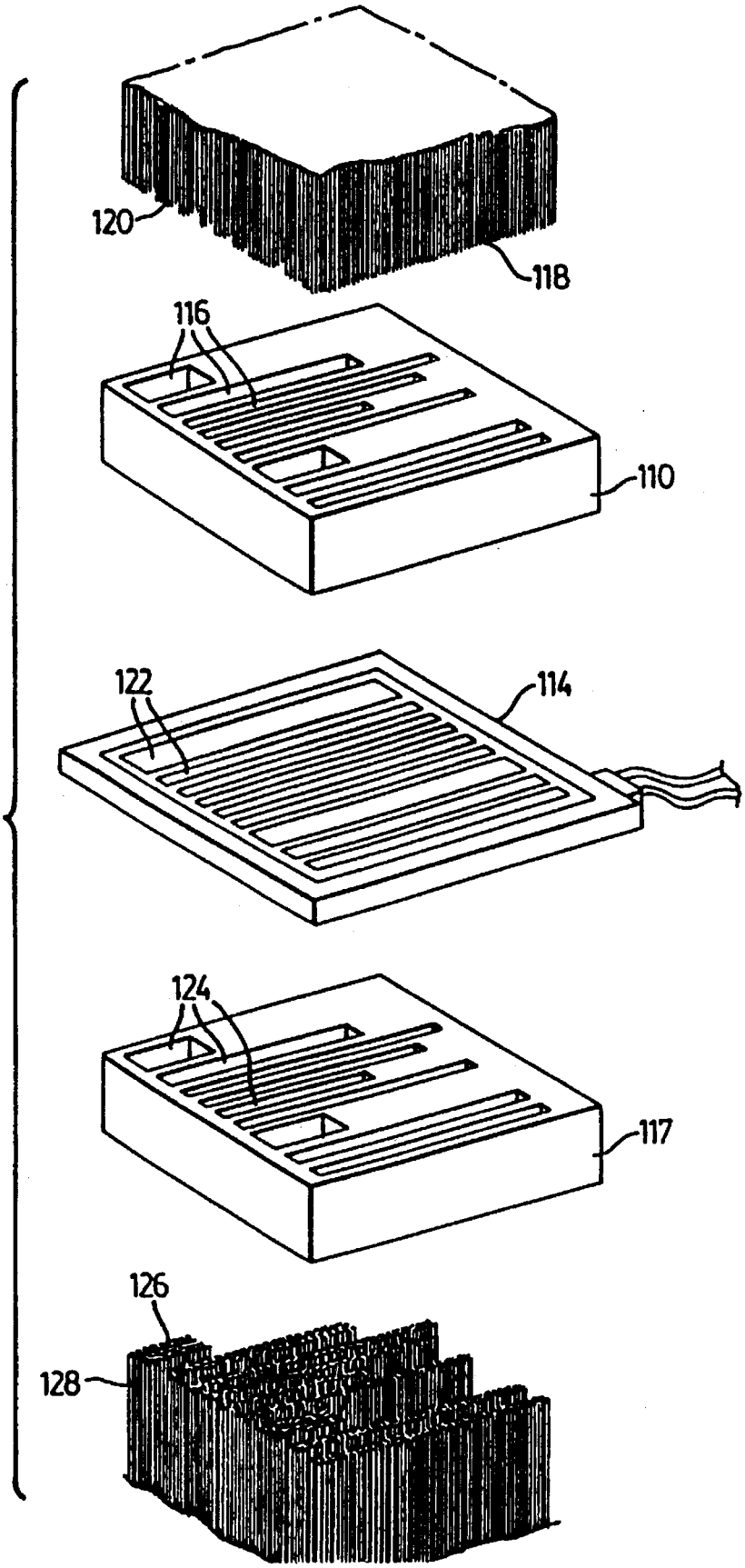
FIG. 10 is an exploded perspective view of an alternative embodiment of the subject light management apparatus.

Referring now to FIG. 10, in an alternative embodiment, the subject light processing means comprises a square input reconfiguration plate 110, liquid crystal filter 114, and square output configuration plate 117. Reconfiguration plate 110 has a series of aligned straight, elongated slots 116 of pre-selected lengths for holding the output ends 118 of input bundle of light guides 120. Liquid crystal filter 114 may be a microprocessor-controlled active or passive liquid crystal matrix having a series of linear, elongated colour zones 122 which when activated by the microprocessor periodically change colour. Output configuration plate 117 has a series of slots 124, which are preferably mirror images of slots 116, for holding input ends 126 of output light guides 128. Alternatively, while colour zones 122 and slots 116 and 124 as illustrated define a plurality of linear, elongated light paths, it should be understood that colour zones 122 could assume other shapes (e.g. circular, amorphous), in which case slots 116, 124 would be reshaped to correspond therewith. Light passing through slots 116 of input plate 110 is filtered by colour zones 122 as it passes therethrough. Preferably, when liquid crystal filter 112 is activated, colours flow across its surface in a predetermined fashion to create the effect of painting with colour.

The processing apparatus of the subject invention makes the input light more uniform, and provides more accurate illumination of an end effects panel, particularly in the case of animation. The reconfigured light paths created by the input harness of light guides and the reconfiguration plates reduce or eliminate light cross-over from one path to another, while at the same time maximizing the amount of light transmission through the colour wheel. The subject apparatus also reduces the risk of heat damage to the colour wheel, because it is placed farther away from the light source between the two configuration plates. As a result, light weight acetate colour wheels having a full range of colour combinations, may be used and rotated with a small, low torque motor.

While the subject light processing apparatus is illustrated as processing light used to produce visual effects on a display panel such as a sign, it should be appreciated that such control apparatus can also be used in many other lighting applications, such as moving light from one spot light to another in a pre-selected pattern, and holographic and other displays.

Further, while fibre optic light guides are the presently preferred means for distributing light into a plurality of input and output paths, other types of light guides, such as water-filled tubes, could be used to so distribute the light. Likewise, a casting of light guiding material of appropriate shape having an exterior coating with a suitable refractive index for reflecting light being transmitted therethrough, could be used instead of a plurality of light guides.

The presently preferred embodiments of the invention comprise the light processing apparatus shown in FIGS. 11–14.

Figure 11:
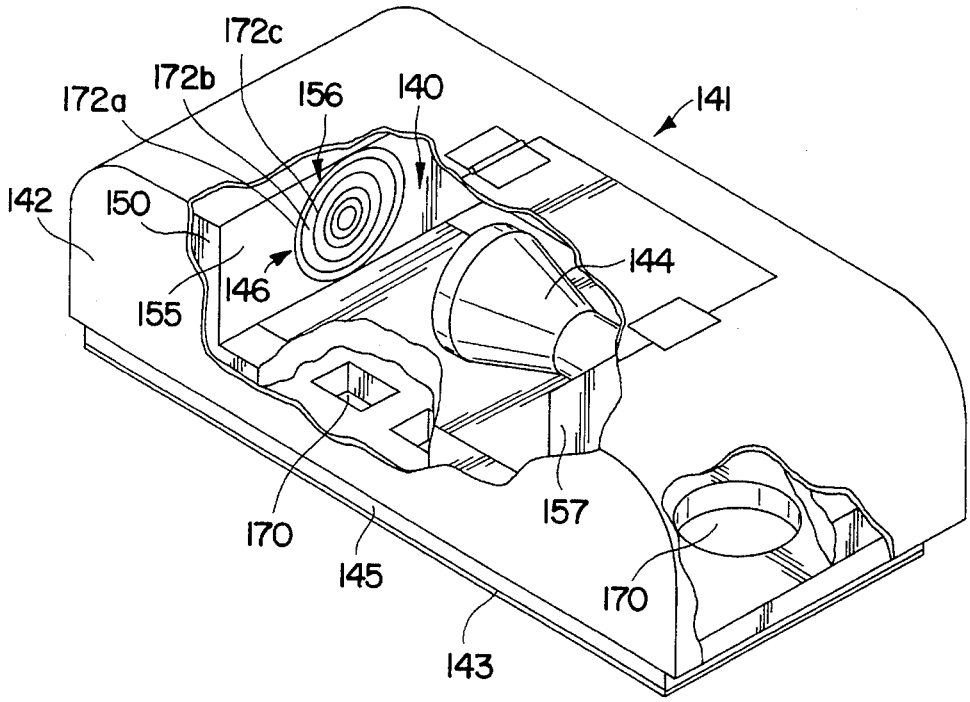
FIG. 11 is a partially cut-away perspective view of a sign embodying the presently preferred embodiment of the subject invention.
Figure 12:
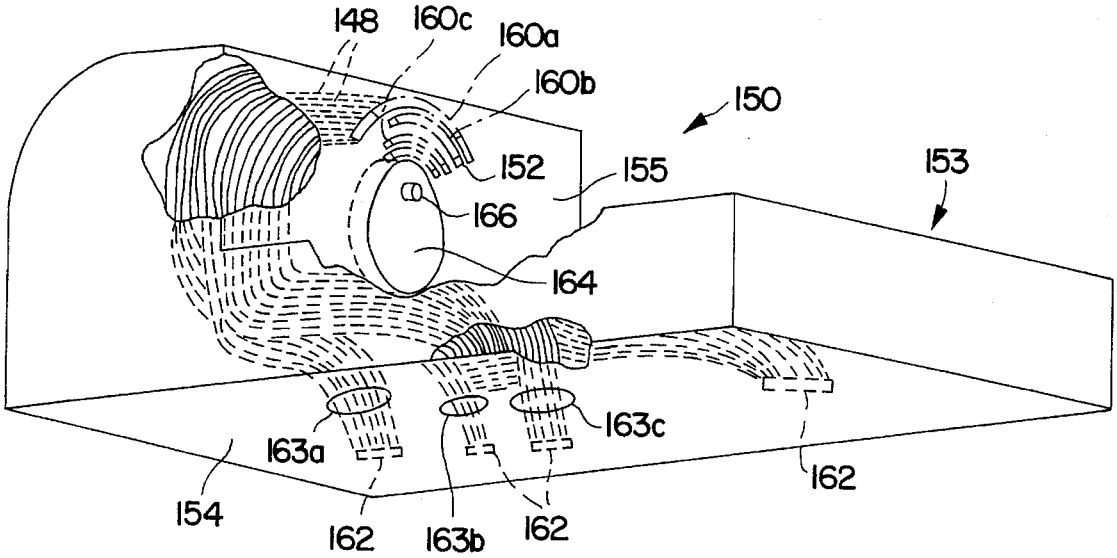
FIG. 12 is a partially cut-away perspective view of a portion of the presently preferred embodiment of the subject apparatus.

Referring now to FIGS. 11 and 12, light processing apparatus 140 is shown as part of sign 141, which comprises housing 142, display panel 143, light source 144 and spacer 145. Light processing apparatus 140 comprises colour changer shown generally as 146, fibre optic light guides 148, and configuring means 150. Light from light source 144 is processed by light processing means 140, to create special effects on a display panel 143 which simulate movement, such as linear movement, spinning, sparkling or twinkling.

As best shown in FIG. 12, configuring means 150 preferably comprises a rigid piece of molded foam such as polystyrene, having a top surface 153, a bottom effects surface 154, and an input surface 155. Top surface 153 supports chassis 157 in which is mounted light source 144. Input surface 155 as shown is orthogonal to top surface 153, and has apertures for holding and positioning input ends 152 of light guides 148 in receptor zones 160 of pre-selected geometry. Bottom effects surface 154 has apertures for holding and positioning output ends 162 of light guides 148 in a pre-selected pattern. Configuring means 150 also preferably encapsulates light guides 148 along the length thereof.

As shown in FIGS. 11 and 12, receptor zones 160 are arcuate or curved, so as to be used in conjunction with colour changer 146 comprising a rotatable colour wheel filter 156 having circular geometry. Alternative geometric arrangements of the colour filter changer and receptor zones will be discussed below. Light guides 148 are grouped into groups 163*a*, 163*b*, 163*c*, etc., each group being assigned to create a particular special effect. All of the input ends 152 of a particular group 163 are held in apertures in input surface 155 in the same receptor zone 160.

Display panel 143 may be spaced a pre-determined distance from the effects surface 154 of configuring means 150 by spacer 145, which is preferably made of a foam like material such as polystyrene. Spacer 145 has cut-outs 170 which allow light emitted from output ends 162 of light guides 148 to travel through spacer 145, thereby illuminating selected portions of display panel 143.

Colour changer 146 comprises colour wheel filter 156 and motor 164 having a drive shaft 166 sized to fit a central aperture in filter 156. Colour wheel filter 156 includes a plurality of discrete concentric coloured filter zones 172*a*, 172*b*, 172*c* etc. in the shape of sectors of an annulus, so as to correlate with respective receptor zones 160*a*, 160*b*, 160*c*, etc. That portion of each annulus which is not coloured is opaque, to block light from being transmitted through such portion. Filter zones 172 are at least as wide as arcuately shaped receptor zones 160, in order to block light filtered by a given filter zone and meant to be transmitted by a correlated receptor zone from also impinging upon adjacent non-correlated zones.

Colour wheel filter 156 is preferably a circular polycarbonate disc having concentric arcuate filter zones created by silk-screening, using inks which transmit light of selected colours or wavelengths, while filtering out non-selected colours. The lengths of the coloured portions of coloured filter zones 182 depend upon the duration of each visual effect. The colour wheel filter also acts as a heat shield to protect the input ends 152 of light guides 148.

Light guides 148 are preferably low-cost plastic (polymethylmethacrylate) fibres, although they may be glass (silica) fibres. The input ends 152 and output ends 162 of light guides 148 are highly polished or otherwise optically finished to an optical quality standard so that maximum light transmission is achieved.

Display panel 143 is preferably made of Lexan (Trade Mark) having a smooth outer side and a rough finish on the inside. A graphic image such as an advertisement may be lithographically or screen printed on the smooth outer side. The rough inside surface of display panel 143 diffuses the light points from the output ends 162. Display panel 143 should be placed a distance from effects surface 154 to help diffuse the light from output ends 162.

In operation, light emitted from light source 144 is directed onto and transmitted through colour wheel filter 156 and is received by input ends 152 of light guides 148 located in receptor zones 160. This filtered light is then distributed by light guides 148 to pre-selected locations on the bottom effects surface 154 of configuring means 150. The light then passes through spacer 145 and is received on the inside surface of display panel 143. As colour wheel filter 156 is rotated by motor 164, various filter zones 172 periodically register with correlated receptor zones 160, resulting in the periodic transmission of filtered light. As the leading edge of each filter zone 172 crosses the front of a receptor zone 160, the coloured light begins to be transmitted into the input ends 152 of light guides 148. The filtered light then travels through a particular group 163 of light guides 148 and is emitted from output ends 162 onto display panel 143. As the filter zones 172 sweep across the receptor zones 160, the effect of movement and flow is created. Different designs require a different number of light fibre groups 163 and different colour wheels 156 having receptor zones 160 of various lengths and colours, depending on the number and type of the desired special effects.

Figure 13:
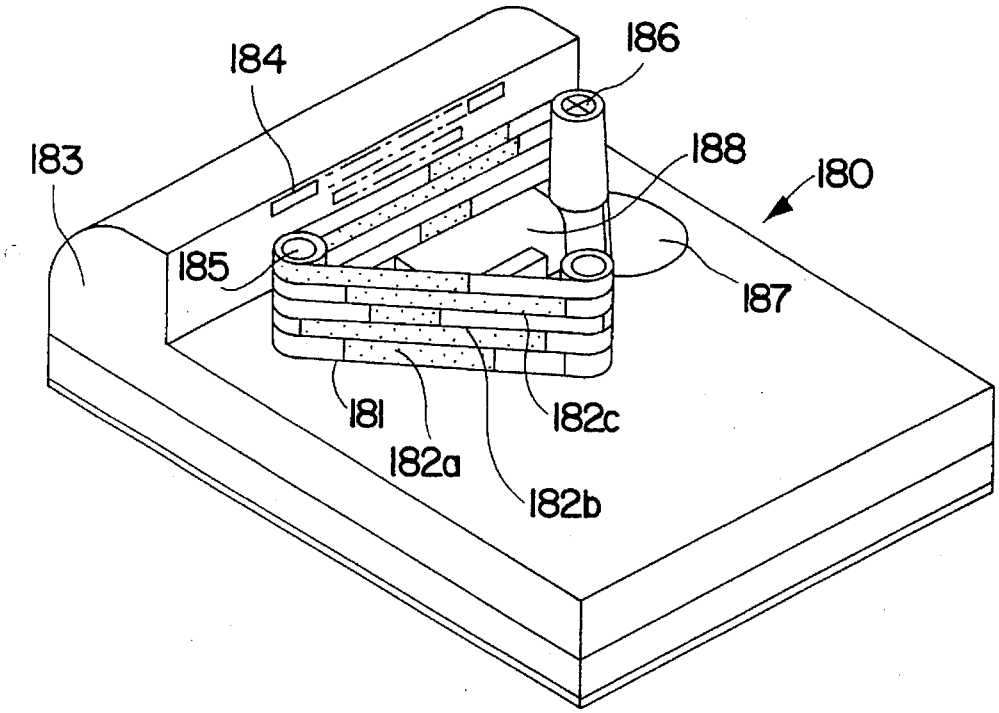
FIG. 13 is a perspective view of an alternative embodiment of the subject light processing apparatus having a colour band filter.
Figure 14:
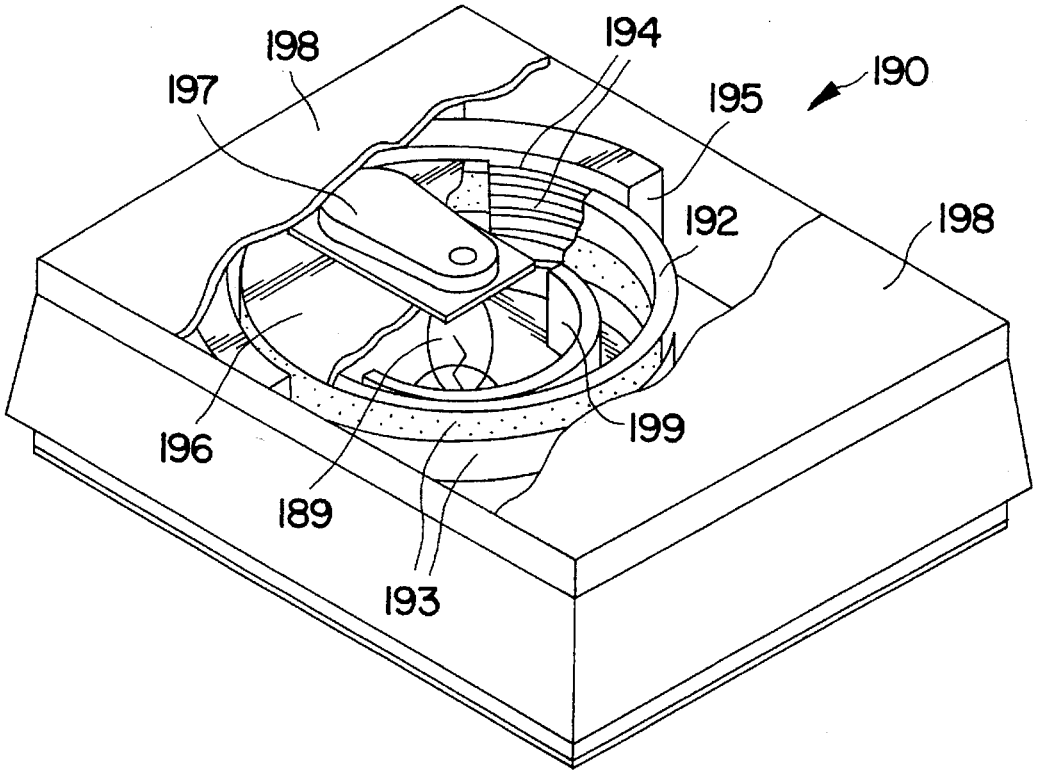
FIG. 14 is a partially cut-away perspective of a sign embodying a further alternative embodiment of the subject invention having a colour cylinder filter.

Referring now to FIGS. 13 and 14, illustrated therein are alternative embodiments of the subject light processing apparatus having different receptor/filter zone geometries. FIG. 13 shows alternative embodiment 180 wherein the colour changing means comprises an endless flexible band filter 181 having a plurality of parallel linear coloured filter zones 182*a*, 182*b*, 182*c* etc., which are rectangular in shape. Configuring means 183 has receptor zones 184, the width of which corresponds to the width of coloured filter zones 182. Colour band filter 181 rotates around spindles 185, and is driven by drive spindle 186, activated by motor 187. During operation, colour band filter 181 rotates around the spindles and achieves the same visual effect as the previously described colour wheel filter 156. In this embodiment, the light source 188 is preferably rectangular in shape, to provide uniform illumination of receptor zones 184.

FIG. 14 shows a further alternative embodiment of the subject invention, shown generally as 190, in which the colour changing means comprises a rotatable colour cylinder filter 192, having a plurality of discrete coloured filter zones 193, comprising stacked, parallel sections of a cylinder, which correspond in width and shape to receptor zones 194 on configuring means 195. Colour cylinder filter 192 is in the shape of a cylindrical barrel having flat bottom portion 196 which is connected to motor 197 mounted to sign housing 198. Reflector 199 reflects light from light source 189 mounted on configuring means 195.

While the colour changing means of the presently preferred embodiments of the invention comprise filters having filter zones which transmit light of a constant, pre-selected colour, the filter could alternately be an active filter having zones which change colour. For example, the filter could be a thin circular disc containing coloured liquids of different densities, which mix together creating a colour blending effect when the disc is rotated.

Thus, while what is shown and described herein constitutes various preferred and alternative embodiments of the subject invention, it will be understood that various changes can be made to such embodiments without departing from the subject invention, the scope of which is defined in the appended claims.

We claim:

1. Light processing apparatus for creating on a display surface special effects which simulate movement, using light from a light source, comprising:

(a) a multiplicity of flexible fibre optic light guides having input ends for receiving the light from the light source and output ends, the light guides being grouped into groups, each group creating a particular special effect, wherein the input ends of each group of light guides are placed in distinct receptor zones which define a pre-selected geometry and the output ends of each group of light guides are positioned in a pre-selected pattern; and (b) a moveable color changing means for periodically changing the color of the light from the light source, comprising a plurality of discrete colored filter zones which transmit light of various colors, wherein each of the filter zones defines a preselected geometry which is substantially the same width and geometric pattern as said receptor zone wherein the filter zones successively register with and sweep across the correlated receptor zones, thereby periodically changing the color of the light which is transmitted to the input ends of various groups of light guides.

2. The apparatus as defined in claim 1, wherein the colour changing means comprises a rotatable circular colour wheel filter having concentric coloured filter zones in the shape of sectors of an annulus.

3. The apparatus as defined in claim 2, wherein the receptor zones are arcuate in shape and no greater in width than the filter zones on the colour wheel filter.

4. The apparatus as defined in claim 1 which additionally comprises configuring means for configuring the input ends and the output ends of the light guides in pre-selected positions.

5. The apparatus as defined in claim 4, wherein the configuring means comprises:

(a) an input surface for holding and positioning the input ends of the light guides in their pre-selected geometry in the receptor zones; and (b) an effects surface for holding and positioning the output ends of the light guides in their pre-selected pattern.

6. The apparatus as defined in claim 5, wherein the configuring means also comprises a support surface for supporting and positioning the light source relative to the colour changing means.

7. The apparatus as defined in claim 6, wherein the input surface defines a plane which is perpendicular to a plane of said support surface, and supports the color changing means.

8. The apparatus as defined in claim 7, wherein the color changing means comprises a rotatable circular color wheel filter which is coupled to a motor.

9. The apparatus as defined in claim 5, wherein the configuring means is a piece of foamed material which encapsulates the light guides.

10. The apparatus as defined in claim 1 wherein the color changing means comprises an endless flexible filter.

11. The apparatus as defined in claim 10, wherein the receptor zones and an interactive portion of said filter zone have the same width.

12. The apparatus as defined in claim 11, wherein the receptor zones are of the same shape and not greater in width than the filter zones.

13. A visual effects sign, comprising:

(a) a housing;

(b) a light source mounted in the housing;

(c) a multiplicity of flexible fibre optic light guides having input ends and output ends, the light guides being grouped into groups, and each group being assigned to create a particular special effect, wherein each input end of each group of light guides are placed in adjacent and distinct receptor zones of preselected geometry and the output ends of each group of light guides are configures in a pre-selected pattern;

(d) color changing means having a plurality of discrete colored filter zones for periodically changing the color of light from the light source, wherein each of the filter zones defines a preselected geometry which is substantially the same width and geometric pattern as said receptor zone;

(e) configuring means for configuring the light source, color changing means and light guides in pre-selected positions relative to one another; and (f) display panel means for displaying light emitted form.

14. The visual effects sign defined in claim 13, wherein the configuring means comprises an input surface for holding and positioning the input ends of the light guides in their pre-selected geometry in the receptor zones, and an effects surface for holding and positioning the output ends of the light guides in their pre-selected pattern.

15. The visual effects sign defined in claim 14, wherein the configuring means comprises a foamed material which encapsulates the light guides.

16. The visual effects sign defined in claim 13, further comprising spacer means for spacing the display panel means a pre-determined distance from the configuring means.

17. Light processing apparatus for creating on a display surface special effects which simulate movement, using light from a light source, comprising:

(a) a multiplicity of flexible fibre optic light guides having input ends for receiving the light from the light source and output ends, the light guides being grouped into groups, each group creating a particular special effect, wherein the input ends of each group of light guides are placed in distinct receptor zones which define a pre-selected geometry and the output ends of each group of light guides are positioned in a pre-selected pattern; and (b) a moveable color changing means for periodically changing the color of the light from the light source, comprising a plurality of discrete colored filter zones which transmit light of various colors, wherein each of the filter zones defines a preselected geometry which is at least as wide as said receptor zones and having the same geometric pattern as said receptor zone wherein the filter zones successively register with and sweep across the correlated receptor zones, thereby periodically changing the color of the light which is transmitted to the input ends of various groups of light guides.

* * * * *